United States Patent [19]

Fieni

[11] 4,324,428

[45] Apr. 13, 1982

[54] WOOD CARRIER

[76] Inventor: Gabriel J. Fieni, 31 Cedar La., Douglassville, Pa. 19518

[21] Appl. No.: 107,513

[22] Filed: Dec. 27, 1979

[51] Int. Cl.[3] ..... B65D 71/00

[52] U.S. Cl. ..... 294/169; 294/143

[58] Field of Search ..... 224/45 E, 45 F, 45 G, 224/45 P, 45 Q, 45 W, 248, 270; 294/29, 32, 67 BC, 97, 104, 106, 169, 143

[56] References Cited

U.S. PATENT DOCUMENTS

| | | | |
|---|---|---|---|
| 398,902 | 3/1889 | Payne | 224/45 E |
| 3,232,503 | 2/1966 | Thonen | 224/45 P |
| 3,303,978 | 2/1967 | Brown | 224/45 W |
| 4,200,040 | 4/1980 | MacRae | 224/45 W X |

*Primary Examiner*—Steven M. Pollard

*Attorney, Agent, or Firm*—Wigman & Cohen

[57] ABSTRACT

A device for carrying wooden logs and the like includes two wire frames for containing the logs; a handle for lifting the wire frames; and flanges, connected to the handle, for moving one wire frame relative to the other wire frame. A method of carrying the logs comprises the steps of transporting the device, including the two wire frames and the handle, near to the logs to be carried; moving one wire frame relative to the other so that any one of a number of desired volumes of space is provided therebetween; placing the logs in the one desired volume of space defined between the two wire frames so that the logs are contained therein; lifting by the handle the two wire frames containing the logs; and carrying by the handle the two wire frames containing the logs therein to a desired location.

20 Claims, 9 Drawing Figures

WOOD CARRIER

BACKGROUND OF THE INVENTION

1. Field of the Invention

This invention relates to article carriers, in particular, to wood carriers hand-held by a person.

2. Description of the Prior Art

Known prior art devices for carrying wooden logs and the like have frames that are either rigid or, if movable, open up to only a specific location so that only one particular volume of space is provided by the frames for containing the logs to be carried. Such a rigid frame is shown in U.S. Pat. No. 625,927, issued to Hanson et al on May 30, 1899. A movable frame which opens up to provide only one volume of space is shown in Swedish Pat. No. 78,461, issued to Owen et al on Sept. 26, 1933. Another article carrier of interest from a structural standpoint is shown in British Pat. No. 869,651, issued to Jones on June 7, 1961.

Prior art wood carriers which have only one volume of space defined by the frame have not met with great commercial success because the one defined volume is often not desirable due to the different diameters and varying lengths of the logs to be carried. Therefore, it is a problem in the prior art to manufacture a wood carrier having a movable frame capable of being adjusted so that a desired variable volume of space is provided therebetween.

SUMMARY OF THE INVENTION

The invention is a wood carrier having a movable frame capable of being adjusted so that a desired variable volume of space is provided therebetween. The invention also resides in a method of carrying wooden logs and the like having different diameters and varying lengths.

It is a primary object of the present invention to provide a cheap, simply manufacturable, compact, and easily usable wood carrier.

This object and other advantages of the present invention will become readily apparent from the following description thereof.

BRIEF DESCRIPTION OF THE DRAWINGS

FIG. 9 shows a side view of the second embodiment being unfolded to receive wooden logs and the like.

DETAILED DESCRIPTION OF THE PREFERRED EMBODIMENTS

Figure 3:
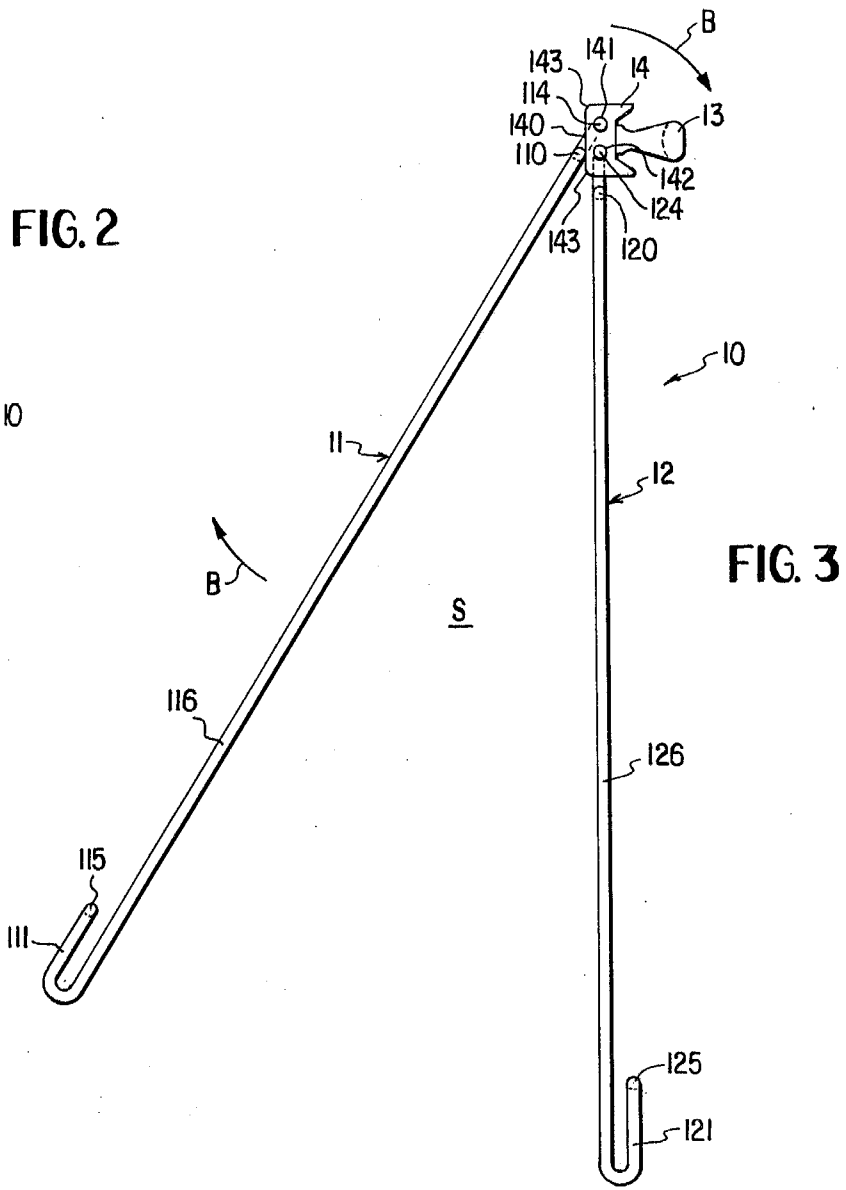
FIG. 3 shows a side view of the first embodiment being unfolded to receive wooden logs.
Figure 5:
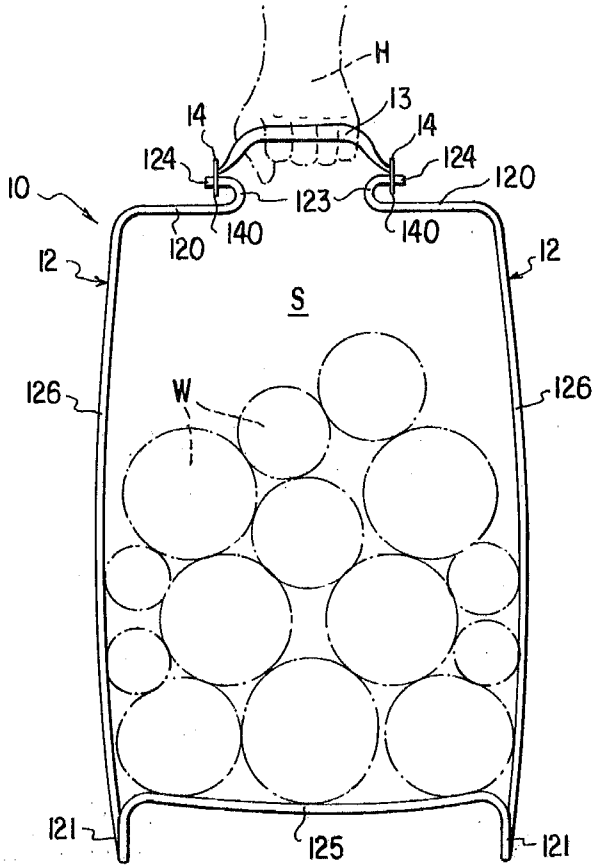
FIG. 5 shows a front view of the first embodiment shown in FIG. 4 with the wooden logs contained therein.
Figure 4:
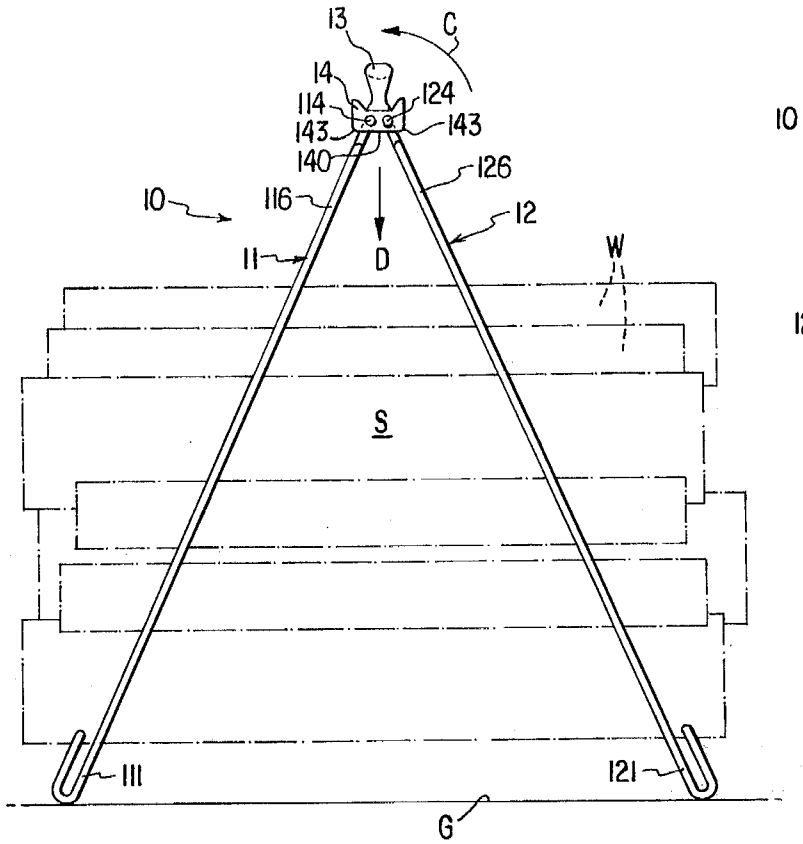
FIG. 4 shows a side view of the first embodiment having wooden logs contained therein in its unfolded condition.

In FIGS. 1–6, a first embodiment of the present invention is shown. A device 10 is utilized for carrying wooden logs W and the like, such as metal tubing, plastic pipes and other cylindrical objects. The wooden logs W are shown in FIGS. 4 and 5 only. The device 10 comprises two wire frames 11 and 12 for containing the wooden logs W and the like. A handle 13 is used for lifting the two wire frames 11 and 12. Flanges 14 are rigidly connected to the handle 13 and move the one wire frame 11 relative to the other wire frame 12 in a manner to be explained below. Alternately, flanges 14 may move the wire frame 12 relative to wire frame 11 in an opposite manner.

Figure 1:
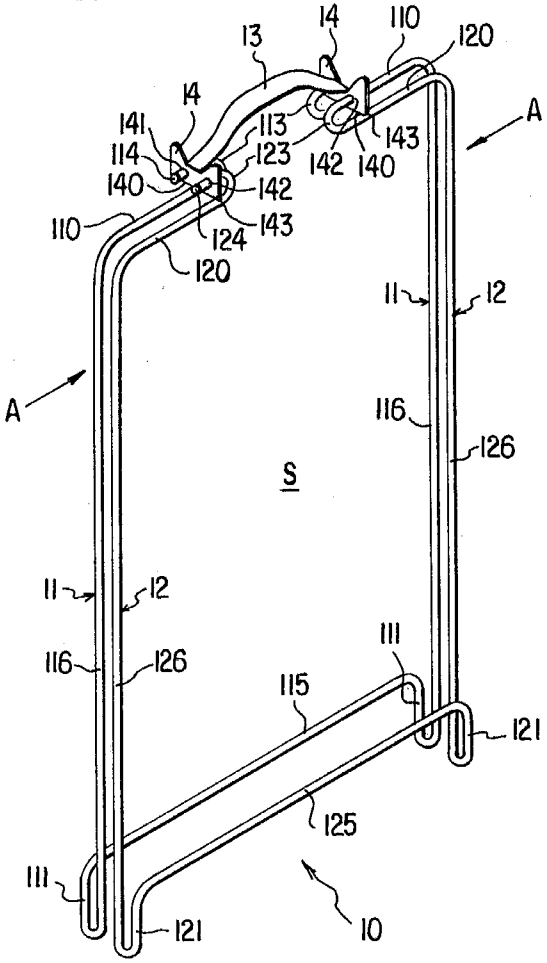
FIG. 1 shows a perspective view of a first embodiment of the wood carrier in its folded condition.

As may be best seen in FIG. 1, the two wire frames 11 and 12 are bent into a substantially rectangular shape when in an unloaded condition. Such a rectangular shape includes, of course, a square shape or a horizontally oriented rectangle, as opposed to the vertically oriented rectangle shown in FIG. 1. The two wire frames 11 and 12 may also be bent into a substantially circular shape. However, the vertically oriented rectangular shape is preferred because such shaped frames 11 and 12 make it easy for a person to carry two devices 10 side by side, that is, one in each hand H as shown in FIG. 5.

The two wire frames 11 and 12 each have an upper shoulder 110 and 120, respectively. The two wire frames 11 and 12 are bent so that there are formed legs 111 and 121, respectively, for keeping the wooden logs W and the like away from the floor, carpet, or ground G, shown in FIG. 4, upon which the legs 111 and 121 rest. The two wire frames 11 and 12 are connected to the handle 13 by the flanges 14. The flanges 14 have bottom edges 140 and corners 143. The flanges 14 also have apertures 141 and 142 for passing the ends 114 and 124 of the two wire frames 11 and 12, respectively, therethrough. The ends 114 and 124 of the two wire frames 11 and 12 are passed loosely through the apertures 141 and 142 of the flanges 14. As best shown in FIG. 1, the ends 114 and 124 of the two wire frames 11 and 12 are on substantially U-shaped sections 113 and 123, respectively. The legs 111 and 121 of the two wire frames 11 and 12 are also formed into a substantial U-shape, as may be seen in FIGS. 1–4, and 6.

The device 10 must be manufactured so that the geometry of the flanges 14 and the substantially U-shaped sections 113 and 123 allows the flanges 14 to move the one wire frame 11 relative to the other wire frame 12. As may be best seen in FIGS. 2 and 3, the distance from the periphery of the one aperture 142 to its near corner 143 must be less than the distance from the bottom of the end wire 124 to the top of the upper shoulder 120. But, equally important, the distance from the periphery of the other aperture 141 to the same corner 143, in this case, the corner farther from aperture 141, must be greater than the distance from the bottom of the end wire 114 to the top of the upper shoulder 110. As seen in FIG. 3, this geometrical arrangement allows the corner 143 of flange 14 to clear over upper shoulder 120 of the other wire frame 12 so that the bottom edge 140 of flange 14 contacts upper shoulder 110 of the one wire frame 11 when handle 13 is rotated in the direction of arrow B. Thus, there is relative movement between the two wire frames 11 and 12.

The two wire frames 11 and 12 each have a horizontally oriented bottom section 115 and 125, respectively, and two vertically oriented side sections 116 and 126, respectively. Between the bottom sections 115 and 125 and the side sections 116 and 126, a variable volume of space S is defined in which the wooden logs W and the like are contained. As may be best seen in FIG. 5, the horizontally oriented bottom sections 115 and 125 and the two vertically oriented side sections 116 and 126 are somewhat resilient so that they may give slightly in order to accommodate wooden logs and the like of different diameters.

Figure 9:
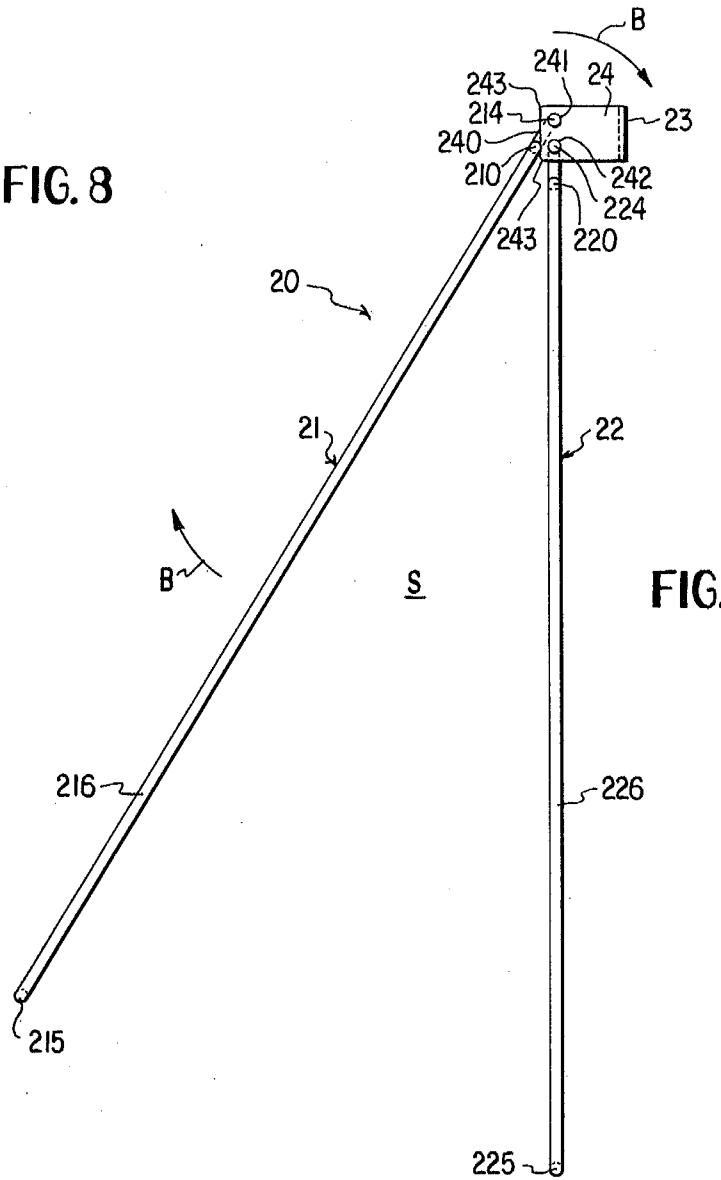
Figure 8:
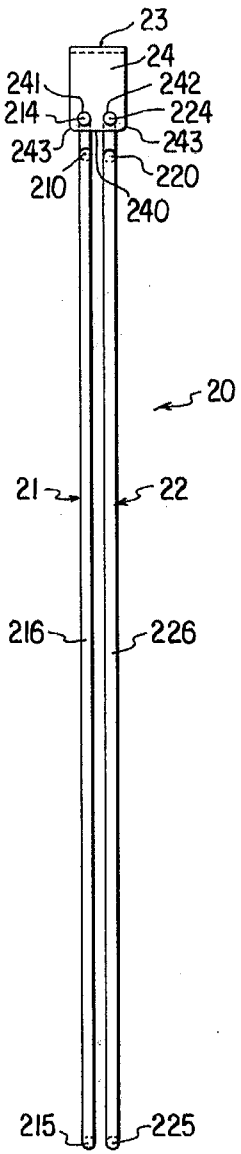
FIG. 8 shows a side view of the second embodiment in its folded condition.
Figure 7:
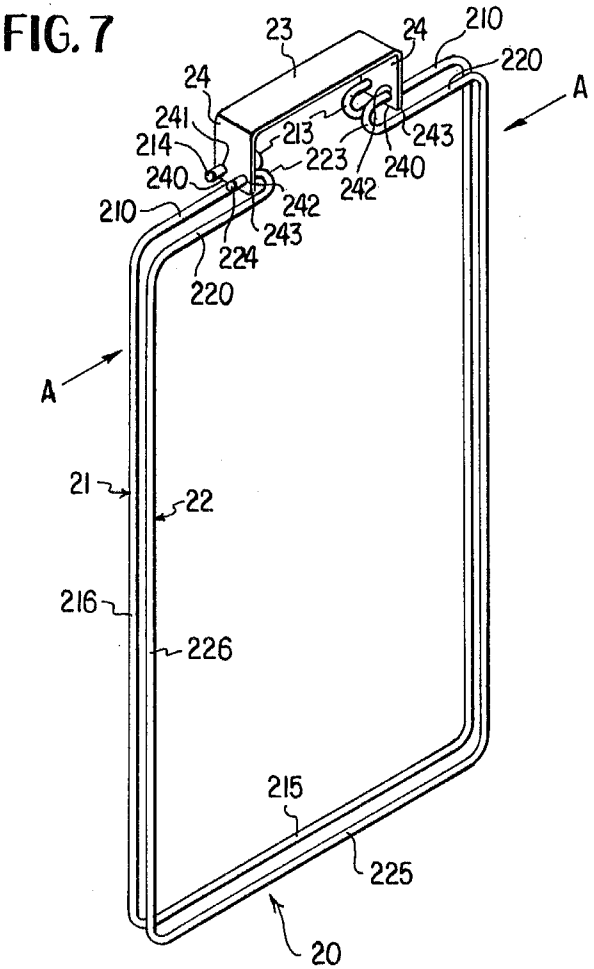
FIG. 7 shows a perspective view of a second embodiment of the wood carrier in its folded condition.

In FIGS. 7–9, a second embodiment of the present invention is shown. A device 20, similar to the device 10 of the first embodiment, is also utilized for carrying wooden logs W and the like. The device 20 functions in substantially the same way as device 10 and comprises substantially the same elements. However, there are differences in the nature of some of the elements. For example, the shape of handle 23 on the device 20 differs from the shape of the handle 13 on the device 10. Nevertheless, because of their functional similarity, handles 13 and 23, with their respective flanges 14 and 24, may be interchanged on devices 10 and 20. As may be best seen in FIG. 7, the interchanging of the handles 13 and 23, is accomplished by pressing the somewhat resilient side sections 216 and 226 of the wire frames 21 and 22 in the direction of the arrow A so that the substantially U-shaped sections 213 and 223 are brought closer together and, thus, allow the ends 214 and 224 to slip out through the apertures 241 and 242 in flanges 24. Handle 23 is thereafter removed from its engagement with the wire frames 21 and 22. Likewise, handle 13 with the flanges 14 may be removed from the wire frames 11 and 12 shown in FIG. 1, in the substantially same manner as handle 23 is removed, by pressing inward on side sections 116 and 126, also in the direction of the arrows A. After handle 13 is removed from the wire frames 11 and 12 and placed in the former position of the handle 23, the inward pressure on side sections 216 and 226 is released so that the ends 214 and 224 of the wire frames 21 and 22 will slip back into apertures 141 and 142 of flanges 14 on newly interchanged handle 13. In a similar manner the handle 23, already removed from engagement with wire frames 21 and 22 of device 20, is placed into engagement with wire frames 11 and 12 of device 10.

Another difference between the devices 10 and 20 is that the device 20 does not have any substantially U-shaped legs, such as the legs 111 and 121 of the device 10, for keeping the wooden logs W and the like somewhat away from the floor, carpet or ground G. Thus, in device 20, the wooden logs W and the like are kept only slightly away from the ground G by a distance equal to the thickness of the bottom sections 215 and 225 of the wire frames 21 and 22, as shown in FIGS. 7–9.

Figure 2:
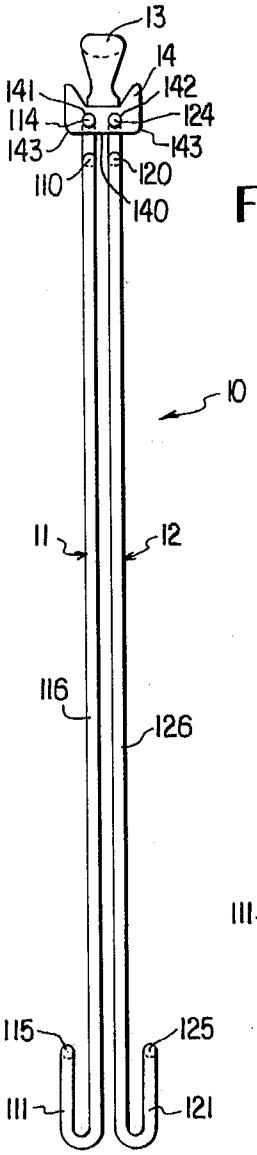
FIG. 2 shows a side view of the first embodiment in its folded condition.

The inventive method of operation and the use of the inventive device will now be described with reference to FIGS. 2–6. The method of carrying the wooden logs W comprises the first step of transporting the device 10, as shown in FIG. 2, to a location close to the wooden logs W and the like to be carried. Either while the device 10 is still being held in the user's hand above the ground G or after the device 10 has been put down onto the ground G, one wire frame 11, as shown in FIG. 3, is moved relative to the other wire frame 12 so that any one of a number of desired volumes of space S is provided therebetween. The volume of the space S is defined by the wire frames 11 and 12 and by the distance separating horizontally oriented bottom sections 115 and 125. Thus, since the lengths of the wire frames 11 and 12 are fixed, the volume of the space S is dependent directly upon how much the user varies the distance separating horizontally oriented bottom sections 115 and 125. This space S is varied by the user when he or she rotates by hand the flanges 14 and the handle 13 in the direction B, as shown in FIG. 3, about the longitudinal axis through the end 124 of the one wire frame 12 so that the bottom edge 140 of the flange 14 clears upper shoulder 120 and is brought into contact with the upper shoulder 110 of the other wire frame 11. Therefore, the other wire frame 11 moves relative to the one wire frame 12 in a substantially circular arc in the direction B.

After movement of the other wire frame 11 relative to the one wire frame 12 and after downward placement in the direction D shown in FIG. 4, both wire frames 11 and 12 are on the floor or ground G upon which the device 10 rests. The flange 14 and the handle 13 may be counter-rotated together by the user by hand in the direction C about the longitudinal axis through the end 124 of the one wire frame 12 without any substantial corresponding movement of the other wire frame 11. There is no movement of the wire frame 11 when it is in contact with the floor or ground G because the friction therebetween is greater than the force needed to counter-rotate the flange 14 and handle 13. As also shown in FIG. 4, wooden logs W of varying lengths may then be loaded in the one volume of space S desired by the user and defined between the two wire frames 11 and 12. After loading, the wooden logs W of varying lengths and also of differing diameters are contained in the space S, as best shown in FIGS. 4 and 5 by the side sections 126 and the bottom section 125 of wire frame 12 and by side sections 116 and bottom section 115 of wire frame 11.

Another advantage of the present invention resides in the fact that the resilience of the side sections 116 and 126 cause the end sections 113 and 123 of wire frames 11 and 12, respectively, to be forced outwardly away from each other so that the flanges 14 are more securely held in the bight of the U-shaped end sections 113 and 123, as best shown in FIG. 5. Thus, loading of the wooden logs W into the space S tightens the connection of the handle 13 to the wire frames 11 and 12 rather than strains such connection, as is the case of some prior art devices.

Once the wooden logs W are contained by the wire frames 11 and 12, the user lifts by hand H the device 10 by gripping the handle 13, as shown in FIG. 5, and carries it to any desirable location, such as next to a fireplace. If the surface near to the fireplace is a hardwood floor or a carpet, the legs 111 and 121 of device 10, keep the wooden logs W, which rest upon bottom sections 115 and 125, away from such floor or carpet and, thus, prevent damage thereto.

Figure 6:
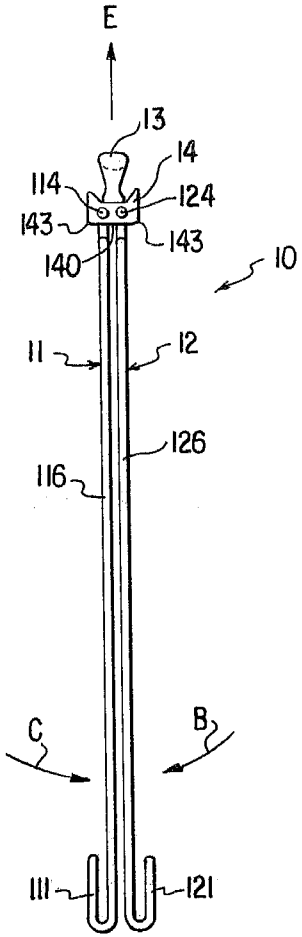
FIG. 6 shows a side view of the first embodiment being folded up after the wooden logs have been removed therefrom.

After the wooden logs W are unloaded from the one volume of space S defined between the two wire frames 11 and 12, the handle 13 is lifted, in the direction E away from the ground G as shown in FIG. 6, so that the two wire frames 11 and 12 move in substantially circular arcs back toward each other in the directions C and B, respectively. Upon such lifting in the direction E, the wire frames 11 and 12 move toward each other because their own weight is sufficient to overcome any frictional resistance to such movement at the points where the legs of the U-shaped end sections 113 and 123 contact the peripheries of apertures 141 and 142. The device 10 may then be stored away for use again at another time.

The foregoing two preferred embodiments are considered as illustrative only. Numerous other modifications and changes will readily occur to those skilled in the pertinent art.

What I claim is:

1. A device for carrying wooden logs and the like, comprising:

a. two wire frame means for containing the wooden logs and the like;

b. handle means for lifting the two wire frame means containing the wooden logs and the like;

c. flange means, rigidly connected to the handle means, for moving one wire frame means relative to the other wire frame means by rotation of said handle means; and d. wherein said two wire frame means each have an upper shoulder and said flange means moves said one wire frame means relative to the other wire frame means when a bottom edge of the flange means contacts the upper shoulder of said one wire frame means.

2. A device, according to claim 1, wherein:

said two wire frame means are bent in such a manner that there are formed leg means for keeping the wooden logs and the like away from the ground upon which the leg means rest.

3. A device, according to claim 2, wherein:

said leg means of the two wire frame means are formed into a substantial U-shape.

4. A device, according to claim 1, wherein:

said two wire frame means are connected to the handle means by the flange means.

5. A device, according to claim 1, wherein:

said flange means also has aperture means for passing ends of the two wire frame means therethrough.

6. A device, according to claim 5, wherein:

said flange means and said handle means are capable of being rotated together about a longitudinal axis through ends of the other wire frame means.

7. A device, according to claim 5, wherein:

said ends of the two wire frame means are passed loosely through the aperture means of the flange means.

8. A device for carrying wooden logs and the like, comprising:

a. two wire frame means for containing the wooden logs and the like;

b. handle means for lifting the two wire frame means containing the wooden logs and the like;

c. flange means, rigidly connected to the handle means, for moving one wire frame means relative to the other wire frame means by rotation of said means; and d. wherein rotation of said flange means and said handle means together about the longitudinal axis through ends of the other wire frame means brings a bottom edge of the flange means into contact with an upper shoulder of the one wire frame means so that the one wire frame means moves relative to said other wire frame means.

9. A device, according to claim 8, wherein:

after movement of said one wire frame means relative to the other wire frame means and after downward placement of both wire frame means on the ground upon which the device rests, said flange means and said handle means together are capable of being counter-rotated about the longitudinal axis through the ends of the other wire frame means without any substantial corresponding movement of said one wire frame means.

10. A device, according to claim 9, wherein:

after removal of the wooden logs and the like contained by the two wire frame means and upon upward lifting of the handle means away from the ground upon which the device rests, said two wire frame means move in a substantially circular arc back towards each other.

11. A device, according to claims 5 or 8, wherein:

said ends of the two wire frame means are on substantially U-shaped sections.

12. A device, according to claims 1 or 8, wherein:

said one wire frame means moves relative to said other wire frame means in a substantially circular arc.

13. A device, according to claims 1 or 8, wherein:

said two wire frame means each have a horizontally oriented bottom section and two vertically oriented side sections between which a variable volume of space is defined for containing the wooden logs and the like.

14. A device, according to claim 13, wherein:

said horizontally oriented bottom section and said two vertically oriented side sections are somewhat resilient.

15. A device for carrying wooden logs and the like, comprising:

two wire frame means for containing the wooden logs and the like;

handle means for lifting the two wire frame means containing the wooden logs and the like;

flange means, rigidly connected to the handle means, for moving one wire frame means relative to the other wire frame means by rotation of said handle means;

said two wire frame means each have an upper shoulder and said flange means moves said one wire frame means relative to the other wire frame means when a bottom edge of the flange means contacts the upper shoulder of said one wire frame means;

said flange means also has aperture means for passing ends of the two wire frame means therethrough;

wherein the distance from the periphery of one aperture means to a near corner of said flange means is less than the distance from the bottom of the end passing through said one aperture means to the top of the upper shoulder of the one wire frame means; and wherein the distance from the periphery of the other aperture means to a far corner on the bottom edge of the flange means is greater than the distance from the bottom of the end passing through said other aperture means to the top of the upper shoulder of the other frame means.

16. A method of carrying wooden logs and the like, comprising the steps of:

a. transporting a device having two wire frames and a handle near to the wooden logs and the like to be carried;

b. moving one wire frame relative to the other wire frame by rotating the handle so that any one of a number of desired volumes of space is provided therebetween;

c. loading the wooden logs and the like in the one desired volume of space defined between said two wire frames so that said wooden logs and the like are contained therein;

d. lifting by said handle said two wire frames containing the wooden logs and the like therein;

e. carrying by said handle said two wire frames containing the wooden logs and the like therein to a desired location; and f. wherein said moving step is accomplished when a bottom edge of a flange rigidly connected to the handle contacts an upper shoulder of the one wire frame.

17. A method of carrying wooden logs and the like, comprising the steps of:

a. transporting a device having two wire frames and a handle near to the wooden logs and the like to be carried;

b. moving one wire frame relative to the other wire frame by rotating the handle so that any one of a number of desired volumes of space is provided therebetween;

c. loading the wooden logs and the like in the one desired volume of space defined between said two wire frames so that said wooden logs and the like are contained therein;

d. lifting by said handle said two wire frames containing the wooden logs and the like therein;

e. carrying by said handle said two wire frames containing the wooden logs and the like therein to a desired location; and f. wherein said moving step is accomplished by rotating the handle and a flange rigidly connected thereto about the longitudinal axis through an end of the other wire frame so that a bottom edge of the flange contacts an upper shoulder of the one wire frame.

18. The method, according to claim 16 or 17 further comprising the step of:

after the loading step and before the lifting step, counter-rotating the handle about the longitudinal axis through the end of the other wire frame without any substantial corresponding movement of the one wire frame.

19. The method, according to claim 18, further comprising the step of:

f. unloading the wooden logs and the like from the one volume of space defined between the two wire frames.

20. The method, according to claim 19, further comprising the step of:

g. lifting by said handle said two wire frames so that said two wire frames move in a substantially circular arc back toward each other.

* * * * *